US011394160B2

(12) United States Patent
Wang

(10) Patent No.: US 11,394,160 B2
(45) Date of Patent: Jul. 19, 2022

(54) SIGNAL COMMUNICATION SOCKET

(71) Applicant: EmCom Technology Inc., Taipei (TW)

(72) Inventor: Chu-Li Wang, Taipei (TW)

(73) Assignee: EMCOM TECHNOLOGY INC., Taipei (TW)

( * ) Notice: Subject to any disclaimer, the term of this patent is extended or adjusted under 35 U.S.C. 154(b) by 0 days.

(21) Appl. No.: 17/027,251

(22) Filed: Sep. 21, 2020

(65) Prior Publication Data

US 2021/0135413 A1 May 6, 2021

(30) Foreign Application Priority Data

Oct. 30, 2019 (TW) ..... 108139357

(51) Int. Cl.

| | |
|---|---|
| ***H01R 24/64*** | (2011.01) |
| ***H01R 13/24*** | (2006.01) |
| ***H01R 13/502*** | (2006.01) |
| ***H01R 13/193*** | (2006.01) |

(52) U.S. Cl.

CPC ..... *H01R 24/64* (2013.01); *H01R 13/193* (2013.01); *H01R 13/2407* (2013.01); *H01R 13/502* (2013.01)

(58) Field of Classification Search

CPC .. H01R 24/64; H01R 13/2407; H01R 13/502; H01R 13/193; H01R 13/5829; H01R 13/5825; H01R 13/5837; H01R 13/40; H01R 13/627; H01R 13/629

See application file for complete search history.

(56) References Cited

U.S. PATENT DOCUMENTS

| | | | | |
|---|---|---|---|---|
| 7,070,457 | B2 | 7/2006 | Kluempke | |
| 7,425,155 | B2 | 9/2008 | Takeuchi | |
| 7,713,081 | B2 | 5/2010 | Chen | |
| 8,007,307 | B2 * | 8/2011 | Wang | H01R 13/506 439/367 |
| 8,758,065 | B2 * | 6/2014 | Fransen | H01R 24/64 439/676 |
| 2005/0202697 | A1 * | 9/2005 | Caveney | H01R 13/6461 439/77 |
| 2013/0122737 | A1 * | 5/2013 | Fransen | H01R 13/648 439/389 |

(Continued)

FOREIGN PATENT DOCUMENTS

| | | | |
|---|---|---|---|
| CN | 101183761 | A | 5/2008 |
| CN | 102801042 | A | 11/2012 |

(Continued)

*Primary Examiner* — Abdullah A Riyami
*Assistant Examiner* — Nelson R. Burgos-Guntin
(74) *Attorney, Agent, or Firm* — Muncy, Geissler, Olds & Lowe, P.C.

(57) ABSTRACT

A signal communication socket for connecting a signal line includes a socket housing defining a signal line channel therein and a slot thereon to communicate with the signal line channel, the slot having at least a first wall surface, and an elastic member detachably inserted into the slot, the elastic member abutting against the first wall surface through elastic extension when no external force is applied, thereby being positioned at the socket housing, wherein one side of the elastic member toward the signal line channel defines a part of a periphery of the signal line channel.

17 Claims, 11 Drawing Sheets

(56) References Cited

U.S. PATENT DOCUMENTS

| | | | | |
|---|---|---|---|---|
| 2014/0227894 | A1* | 8/2014 | Schweizer | H01R 13/6461 439/131 |
| 2014/0273570 | A1* | 9/2014 | Fransen | H01R 27/00 439/174 |
| 2019/0074651 | A1* | 3/2019 | Wang | H01R 13/502 |
| 2019/0229468 | A1* | 7/2019 | Wang | H01R 13/6466 |
| 2021/0135413 | A1* | 5/2021 | Wang | H01R 13/5825 |

FOREIGN PATENT DOCUMENTS

| | | | |
|---|---|---|---|
| TW | 200403895 | A | 3/2004 |
| TW | M349117 | U | 1/2009 |
| TW | M518420 | U | 3/2016 |

* cited by examiner

SIGNAL COMMUNICATION SOCKET

BACKGROUND OF THE INVENTION

1. Field of the Invention

The invention generally relates to a signal communication socket. Particularly, the invention relates to a signal communication socket having an elastic member.

2. Description of the Prior Art

For signal communication sockets such as signal communication sockets used to connect signal lines such as plugs and cables, in order to facilitate the fixing of plugs or cables of different sizes, additional restriction members such as cable ties, clamps, etc. are used to fasten plugs or cable inserted therein. However, such a structure increases the complexity of manual operations. When plugs, cables or other components in the signal communication socket need to be disassembled, these restriction members need to be removed, increasing the required processes and even the tools. In addition, restriction members such as cable ties may become fatigued, damaged, or fall off over time, thereby deteriorating the connection reliability and life of the signal communication socket. Moreover, if the design of the signal communication socket is changed to firmly position the plug or cable, it will increase the difficulty of removing components or the signal line such as the plug or cable from the signal communication socket. For example, it may take more time and effort, or use more tools to operate, resulting in less efficiency of disassembly and assembly. Consequently, the convenience and operability of using the signal communication socket are reduced. In addition, such a signal communication socket is not conducive to changing the configuration to connect plugs or cables of different sizes, thereby limiting the applications of the signal communication socket.

SUMMARY OF THE INVENTION

It is an aspect of the invention to provide a signal communication socket for connecting a signal line, which includes a socket housing and an elastic member. The socket housing defines a signal line channel therein and a slot thereon to communicate with the signal line channel. The slot has at least a first wall surface. The elastic member is detachably inserted into the slot. The elastic member abuts against the first wall surface through elastic extension when no external force is applied, thereby being positioned at the socket housing, wherein one side of the elastic member toward the signal line channel defines a part of a periphery of the signal line channel.

Compared to the prior art, the signal communication socket of the invention can maintain the positioning, the stability and reliability of signal lines such as cable, plug inserted thereinto and improve the convenience of detaching the signal lines or components of the signal communication socket. Moreover, the signal communication socket of the invention can simplify the process of detaching the signal lines or components of the signal communication socket, so as to increase the applications of the signal communication socket.

DETAILED DESCRIPTION OF THE PREFERRED EMBODIMENT

Various embodiments will be described below, and those having ordinary skill in the art can easily understand the spirit and principles of the invention with reference to the description and accompanying drawings. However, although some specific embodiments will be specifically described, these embodiments are merely illustrative, and are not considered to be restrictive or exhaustive in every respect. Therefore, for those having ordinary skill in the art, various changes and modifications to the invention should be obvious and easily achievable without departing from the spirit and principles of the invention.

Figure 1:
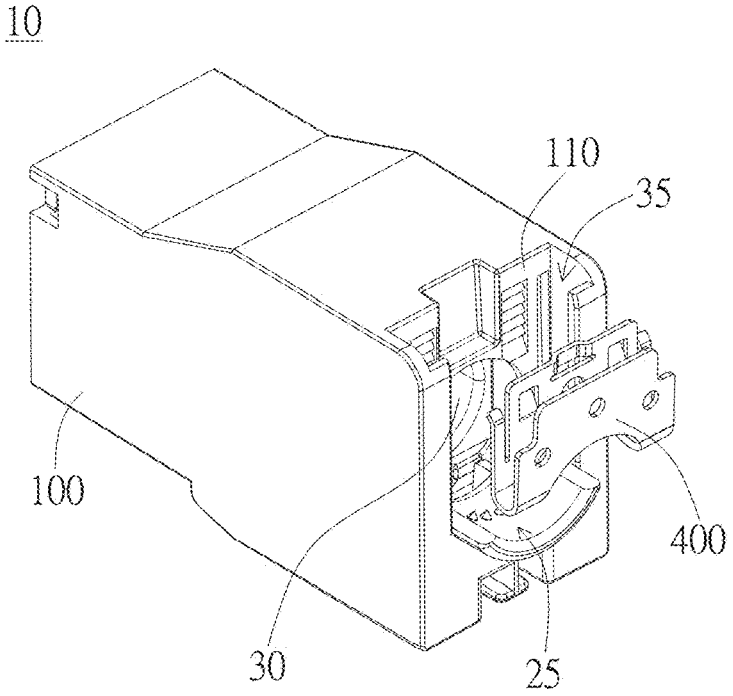
FIG. 1 to FIG. 3 are schematic views of various embodiments of the signal communication socket having the housing and the elastic member of the invention.
Figure 2:
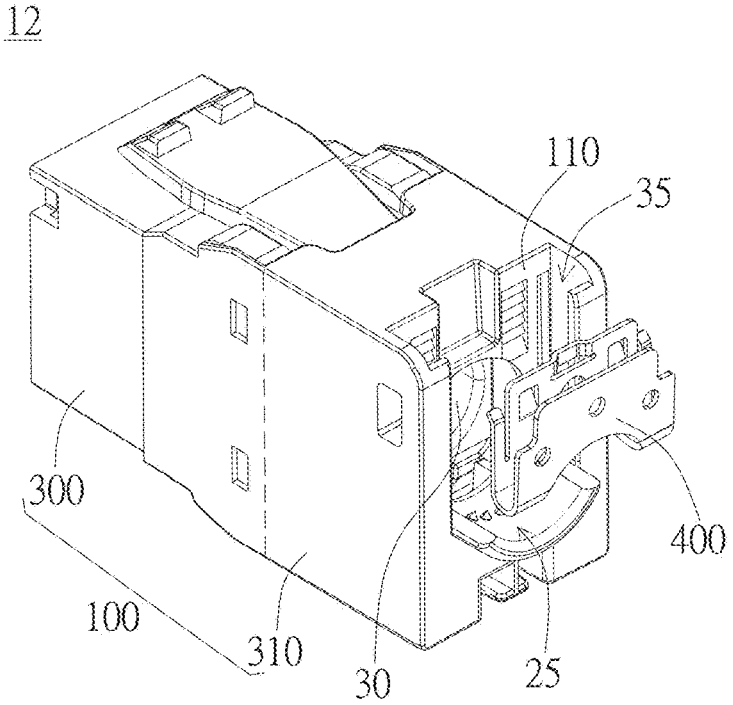
Figure 3:
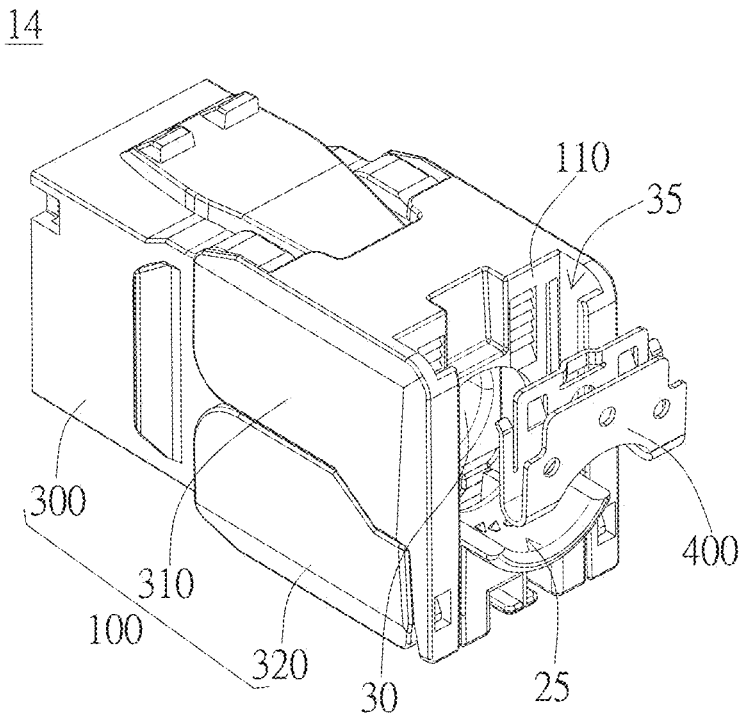

Referring to FIG. 1 to FIG. 3, in various embodiments, the signal communication socket 10, 12, or 14 for connecting a signal line can include a socket housing 100 and an elastic member 400. The socket housing 100 defines a signal line channel 30 therein and a slot 35 thereon. The slot 35 communicates with the signal line channel 30 and has at least a first wall surface 110.

The elastic member 400 is detachably inserted into the slot 35. When the elastic member 400 is inserted into the slot 35 and no external force is applied thereon, the elastic member 400 abuts against the first wall surface 110 through elastic extension, thereby being positioned at the socket housing 100. In addition to the first wall surface 110, the elastic member 400 may also abut against other wall surfaces around the slot 35, so as to be positioned at the socket housing 100. Moreover, in this embodiment, when the elastic member 400 is inserted into the slot 35, one side of the elastic member 400 toward the signal line channel 30 may define a part of a periphery of the signal line channel 30.

For ease of reference to the structure of each component and for clarity, the state that the elastic member 400 has not been inserted into the slot 35 is shown, and the state that the elastic member 400 is completely assembled in the slot 35 will be separately shown later.

Referring to the embodiments shown in FIG. 1 to FIG. 3, according to the invention, the signal communication sockets 10, 12, 14 each may have the elastic member 400 disposed corresponding to the slot 35, and such a configuration can be applied to the socket housing 100 of various configurations. For example, as shown in FIG. 1, the socket housing 100 of the signal communication socket 10 can be an integrally formed housing, which defines the signal line channel 30 therein. The slot 35 is formed on the integrally formed socket housing 100. As shown in FIG. 2, the socket housing 100 of the signal communication socket 12 substantially includes a body 300 and a first cover 310. The first cover 310 can be detachably or rotatably connected to the body 300. In this embodiment, the slot 35 is formed at the first cover 310. When the first cover 310 is assembled with the body 300, the slot 35 communicates with the signal line channel 30. As shown in FIG. 3, the socket housing 100 of the signal communication socket 14 can substantially include a body 300, a first cover 310, and a second cover 320. The first cover 310 and the second cover 320 can be detachably or rotatably connected to the body 300. In this embodiment, the slot 35 can be formed at the first cover 310. When the first cover 310 is assembled with the body 300, the slot 35 communicates with the signal line channel 30.

The invention can be applied to various socket housings 100, not limited to the embodiments, which are merely illustrated as examples. The shape and configuration of the socket housing 100 provided with the slot 35 for the elastic member 400 to be inserted therein and the corresponding locations of the slot 35 and the elastic member 400 on the socket housing 100 are not limited to the embodiments shown in FIG. 1 to FIG. 3. For example, in other embodiments, the socket housing 100 can have the body 300 and the first cover 310, and the slot 35 and the elastic member 400 are disposed on the body 300 instead of the first cover 310.

In an embodiment, the signal line channel 30 defined in the socket housing 100 has a first inlet 25, which can communicate externally, and the elastic member 400 can be disposed corresponding to an edge of the first inlet 25, but not limited thereto. In another embodiment, the elastic member 400 can be deviated from the first inlet 25 or disposed corresponding to the edge of other elements or openings or structures.

Referring to FIG. 1 to FIG. 3, the elastic member 400 can be a U-shaped elastic member formed by metals or plastics. By pressing the U-shaped elastic member 400, the elastic member 400 can be retrieved from the slot 35. When not external force is applied to the U-shaped elastic member 400, the elastic member 400 abuts against the wall surface(s) around the slot 35 through elastic extension toward two opposite sides.

In the above embodiments, by means of the slot 35 and the elastic member 400, when the elastic member 400 is inserted into the slot 35, the slot 35 communicates with the signal line channel 30, and the elastic member 400 defines a part of the periphery of the signal line channel 30 and further affixes the signal line such as the cable, thereby enhancing the positioning of the signal line and improving the stability of connection. In addition, in the above embodiments, the elastic member 400 can be easily removed from the slot 35 by applying force against the elastic force of the elastic member 400, thereby loosening the signal line. As such, the operation of disassembling the signal line or parts of the signal communication socket can be simplified, and the possibility of damaging the signal communication socket caused by excessive force can be prevented.

Figure 4:
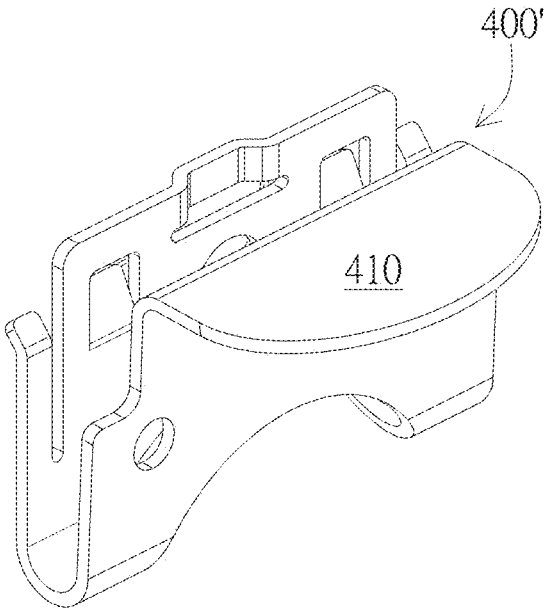
FIG. 4 is a schematic view of another embodiment of the elastic member having the protrusion portion of the invention.

In another embodiment, the elastic member 400 of FIG. 1 to FIG. 3 can be implemented as the elastic member 400' shown in FIG. 4. Specifically, the elastic member 400' further has a pressing portion 410 protruding from the elastic member 400' opposite to the first wall surface 110. By pressing the pressing portion 410, the position of the elastic member 400' in the slot 35 can be readily adjusted, or the elastic member 400' can be removed from the slot 35. The material, configuration, and shape of the elastic member in the embodiments are merely illustrative, and not limited to the embodiments.

Figure 5:
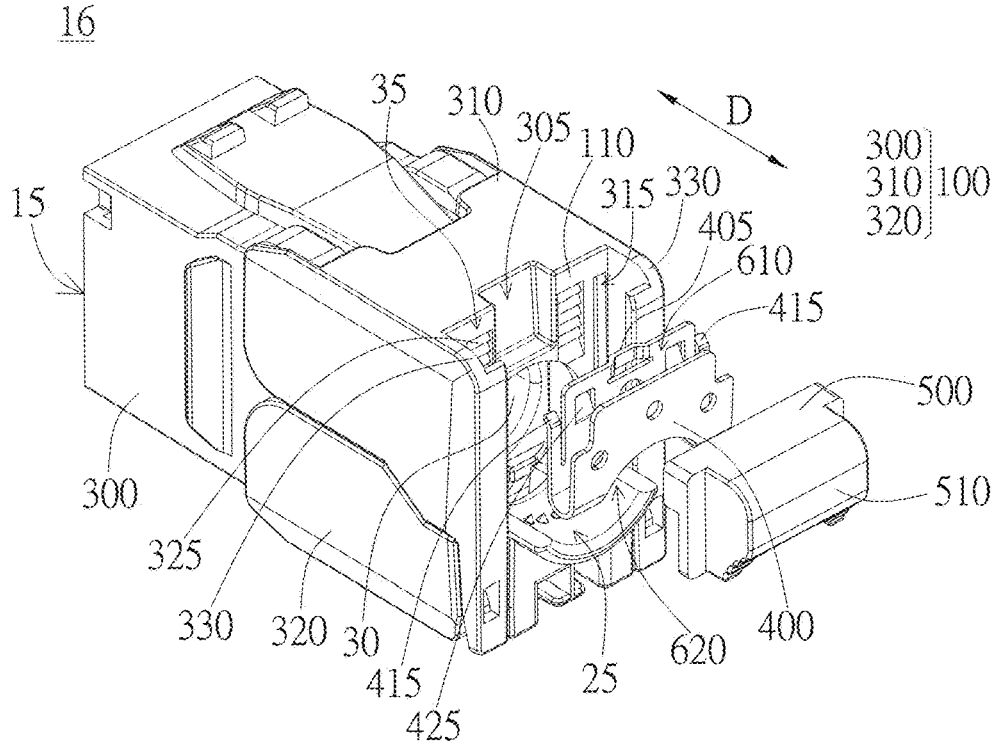
FIG. 5 is a schematic view of another embodiment of the signal communication socket having the pressing portion of the invention.

Referring to FIG. 5, the signal communication socket 16 of another embodiment is illustrated. The signal communication socket 16 is different from the signal communication socket 14 in that the signal communication socket 16 further includes a pressing member 500 disposed corresponding to the slot 35. Specifically, the pressing member 500 couples with the elastic member 400 to be disposed in the slot 35 together. For example, the pressing member 500 couples with the elastic member 400 at a side opposite to the first wall surface 110.

In an embodiment, the pressing member 500 protrudes away from the elastic member 400. As shown in FIG. 5, the pressing member 500 is implemented with a block 510, which protrudes away from the elastic member 400. By pressing the pressing member 500 (e.g., the block 510), the position of the elastic member 400 in the slot 35 can be readily adjusted, or the elastic member 400 can be removed from the slot 35.

Referring to FIG. 5 and the enlarged view of the first wall surface 110 and the elastic member 400 of FIG. 6, the corresponding structures of the first wall surface 110 and the elastic member 400 will be described in detail.

Specifically, in an embodiment, in order to enhance the positioning of the elastic member 400 in the slot 35, the first wall surface 110 and the elastic member 400 can be designed with corresponding structures. For example, the elastic member 400 has at least a protrusion toward the first wall surface 110, and the first wall surface 110 is formed with a corresponding structure to receive, stop, or engaging with the protrusion.

Figure 6:
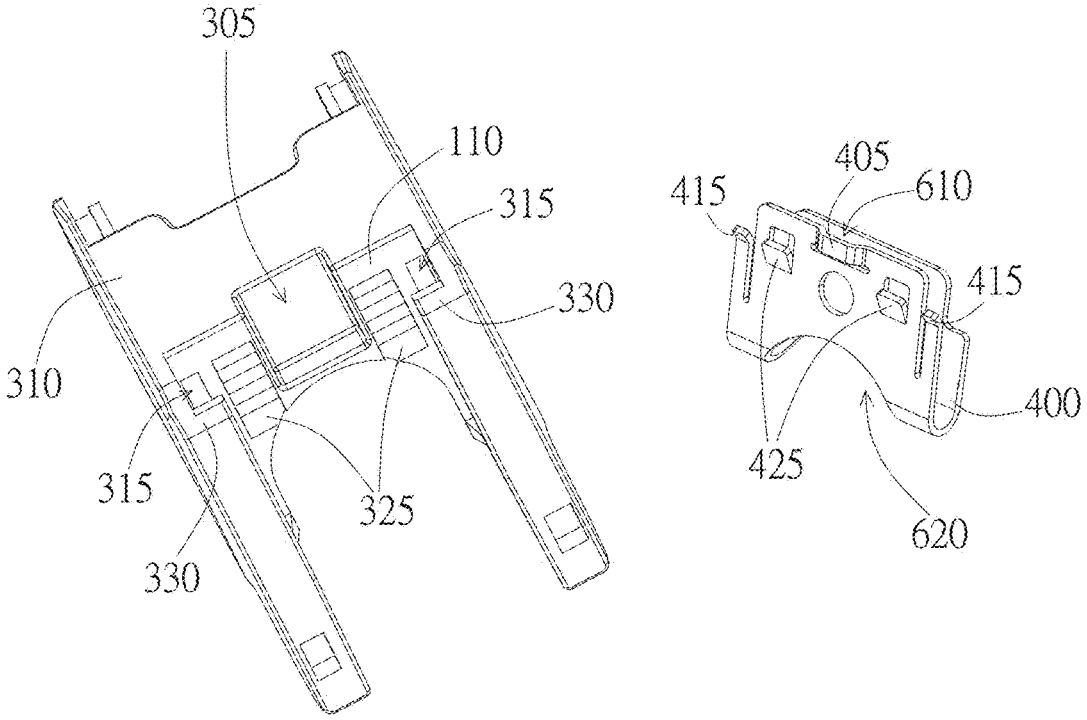
FIG. 6 is a partially enlarged view of the first wall surface and the elastic member of the signal communication socket of FIG. 5.

In an embodiment, as shown in FIG. 5 and FIG. 6, the at least a protrusion of the elastic member 400 may include an abutting portion 425, and the first wall surface 110 is formed with an interfering structure 325 corresponding to the abutting portion 425. When the elastic member 400 is inserted into the slot 35, the abutting portion 425 interferes with the interfering structure 325. As such, compared to a flat surface of the elastic member 400 abuts the first wall surface 110, with the design of the abutting portion 425 and the corresponding interfering structure 325, the elastic member 400 can be prevented from slipping unexpectedly due to collision or other factors. Therefore, the stability of the elastic member 400 disposed in the slot 35 can be further improved.

In another embodiment, as shown in FIG. 5 and FIG. 6, the at least a protrusion of the elastic member 400 can include a positioning portion 415, and the first wall surface 110 is formed with a positioning groove 315 corresponding to the positioning portion 415. When the elastic member 400 is inserted into the slot 35, the positioning portion 415 is inserted into the positioning groove 315. As such, the positioning portion 415 is movable along the positioning groove 315, so as to guide the elastic member 400 to be inserted into the slot 35 along a predetermined direction. As such, the accuracy of positioning the elastic member 400 in the slot 35 can be enhanced.

In yet another embodiment, as shown in FIG. 5 and FIG. 6, the first wall surface 110 can be formed with at least a notch 305. When the elastic member 400 is inserted into the slot 35, at least a portion of the elastic member 400 is exposed outside the socket housing 100 from the at least a notch 305. When the elastic member 400 is removed, the elastic member 400 can be compressed by applying force through the notch 305, so that the elastic member 400 is loosened and can be slidably removed along the slot 35. In some embodiments, in order to press the elastic member 400 conveniently, the at least a protrusion of the elastic member 400 can be a protrusion 405, which protrudes toward the notch 305. As such, it is much easier to apply force to compress the elastic member 400 through the notch 305, so that the elastic member 400 can be removed from the socket housing 100, such as the first cover 310.

In an embodiment, when the elastic member 400 is a U-shaped elastic member, the U-shaped opening 610 of the U-shaped elastic member 400 can face away from the signal line channel 30. As such, the user can apply less force to one side of the elastic member 400, which is opposite to the signal line channel 30, to overcome the elasticity of the elastic member 400, thereby loosening the elastic member 400 and removing the elastic member 400 from the slot 35.

Referring to the exploded views of the signal communication socket 16 shown in FIG. 7A and FIG. 7B, the configuration of the signal communication socket 16 of FIG. 5 will be described.

Figure 8:
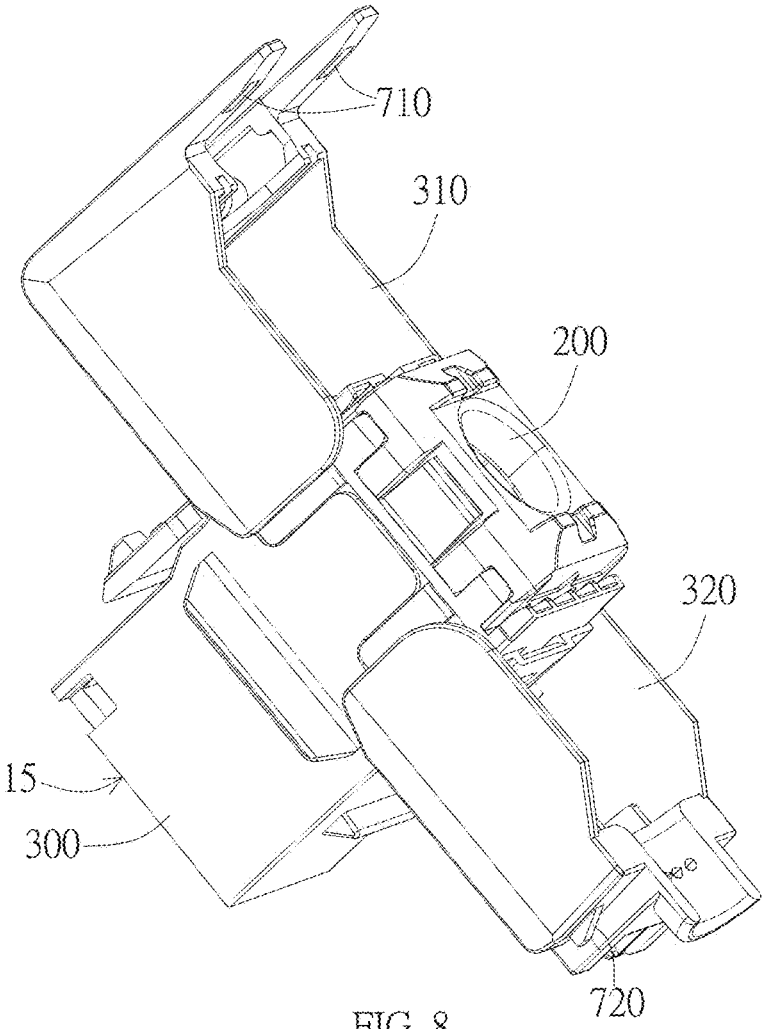
FIG. 8 and FIG. 9 are schematic views of an embodiment of the signal communication socket having first and second casings rotatable with respect to the body of the invention.
Figure 9:
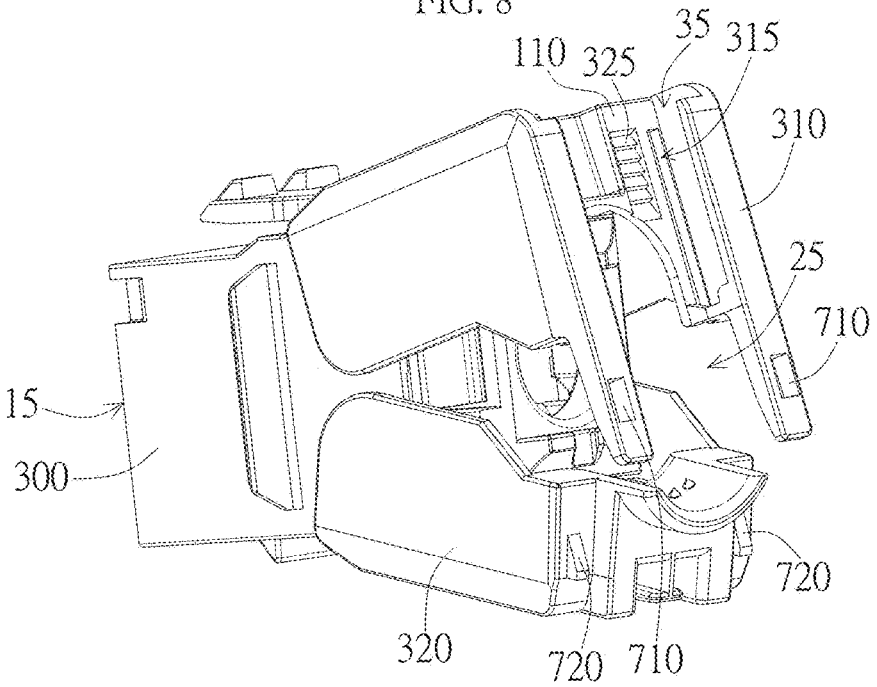

In an embodiment, in addition to the socket housing 100, the elastic member 400, or even the pressing member 500, the signal communication socket 16 can further include a signal line managing member 200 disposed in the signal line channel 30. For example, the signal line managing member 200 is disposed inside the body 300 of the socket housing adjacent to the first cover 310 and the second cover 320. As shown in FIG. 8 and FIG. 9, after assembly, the signal line managing member 200 is at least partially covered by the first cover 310 and the second cover 320 and located in the space defined by the first cover 310 and the second cover 320.

Figure 7A:
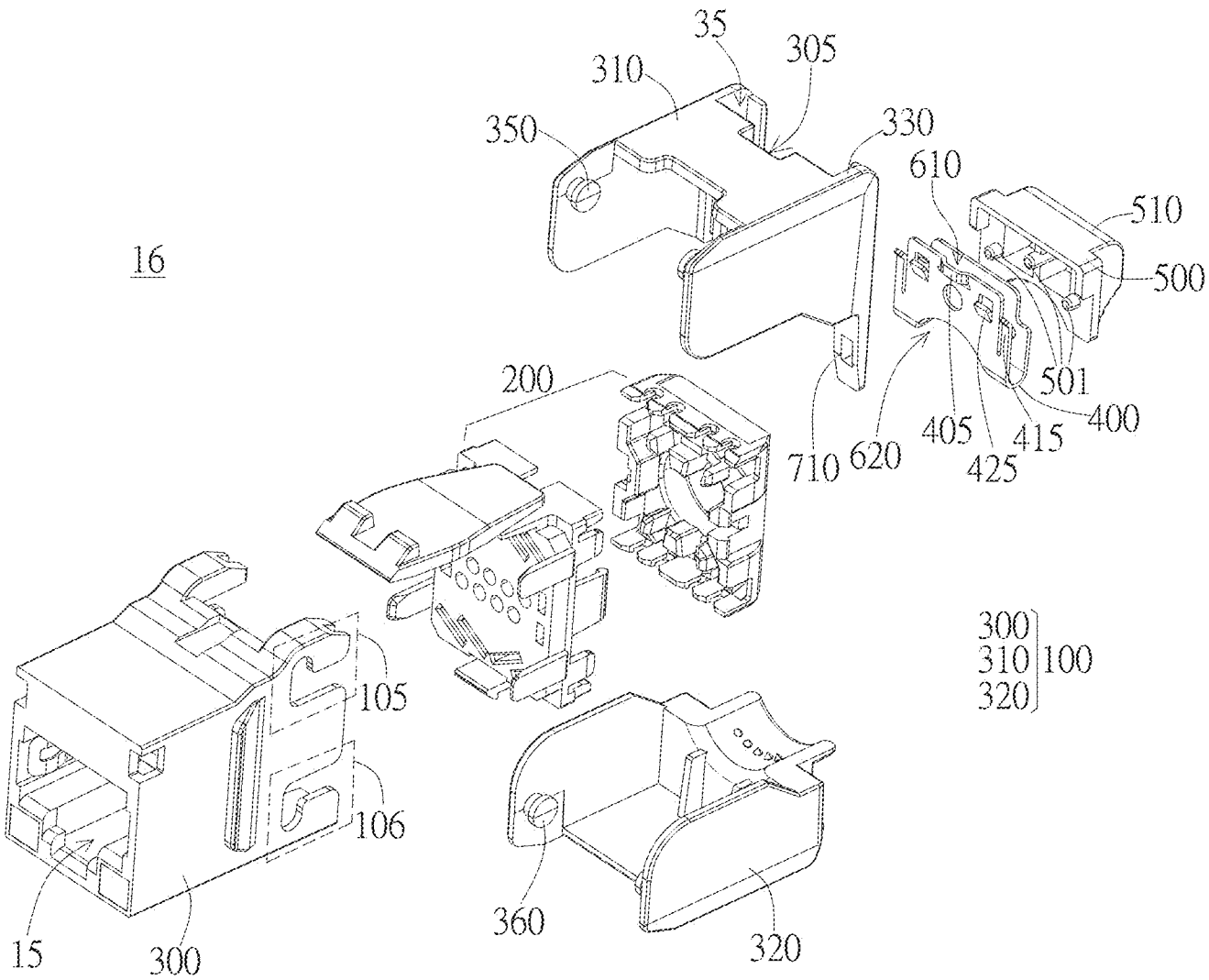
FIG. 7A and FIG. 7B are exploded views of an embodiment of the signal communication socket of the invention from different viewing angles.
Figure 7B:
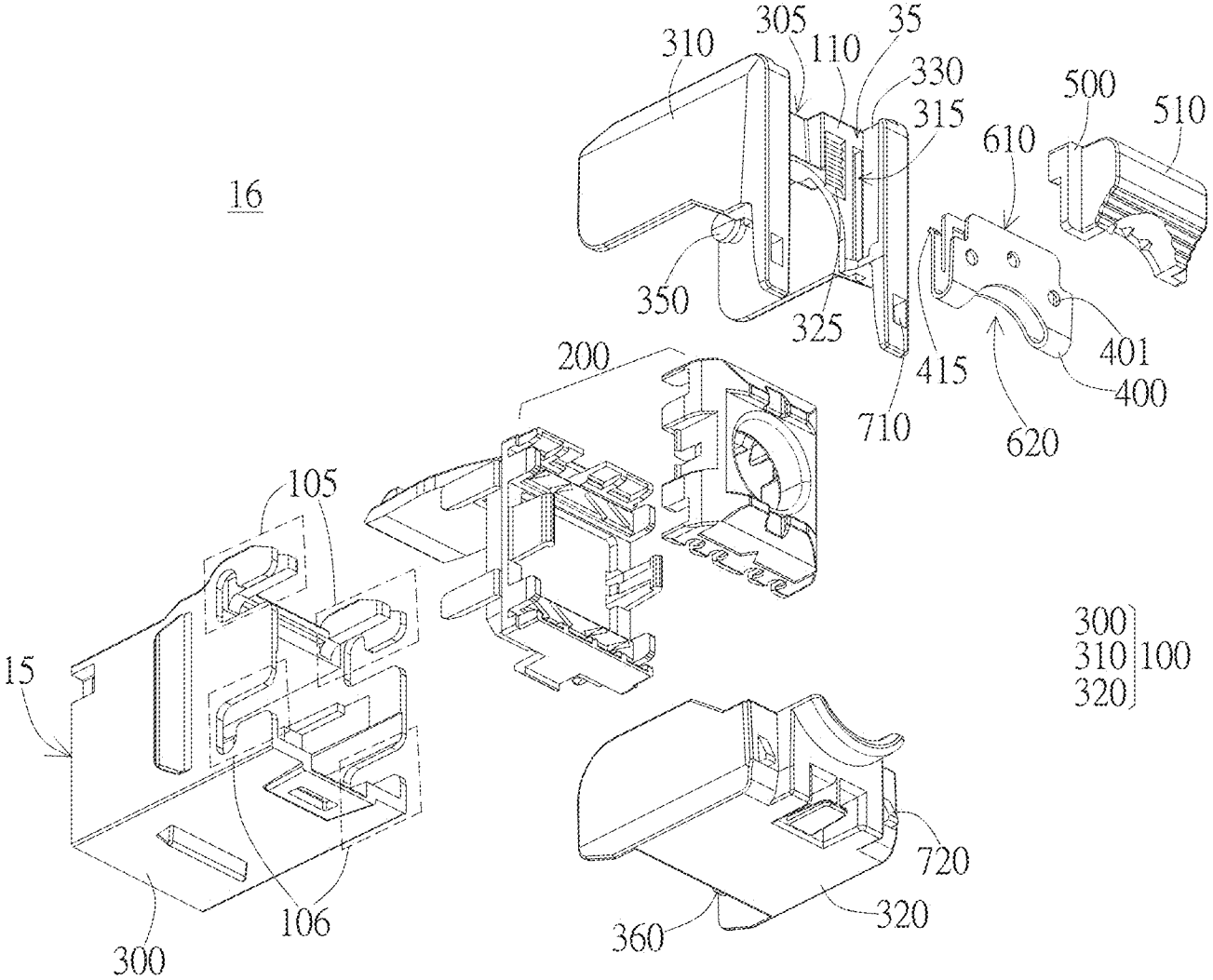

As shown in FIG. 5, FIG. 7A and FIG. 7B, in this embodiment, the signal communication socket 16 can include inlets at different part of the socket housing 100, such as the first inlet 25 and the second inlet 15, which communicate externally. The first inlet 25 and the second inlet 15 can allow different signal lines to be inserted thereinto, so as to form electrical connection through the signal communication socket 16. For example, in an embodiment, the signal line managing member 200 can separately distribute the signal line inserted from the first inlet 25, such as the wires of the cable, to connect the terminals of the plug connected to the second inlet 15, so that the signal line inserted from the first inlet 25 (i.e., the first signal line) can be electrically connected to the signal line inserted from the second inlet 15 (i.e., the second signal line). The first signal line can be a cable, and the second signal line can be a plug, but not limited thereto.

In an embodiment, the signal line managing member 200 can have one or more insulation displacement connectors (IDCs), which pierce the insulation skin of the cable and electrically connect the wires of the cable to other terminals, such as the terminals of the plug in the second inlet 15. The signal line managing member 200 in the embodiment is illustrative, not limited thereto. The signal line managing member 200 can be any suitable component, which facilitates the electrical connection and the directional guidance of the signal line. In another embodiment, the signal communication socket 16 may not have the signal line managing member 200 when the signal lines (e.g., cable and plug) which can transfer signals directly through the signal communication socket 16.

In an embodiment, referring to FIG. 5 to FIG. 7B, the signal line managing member 200 can participate in defining the periphery of the signal line channel 30. Moreover, the elastic member 400 may have a design corresponding to the signal line channel 30. For example, when the elastic member 400 is a U-shaped elastic member, a side of the elastic member 400 corresponding to the signal line channel 30 can have a curved notch 620. The curved notch 620 can serve as a part of the periphery of the signal line channel 30. When the signal line is inserted into the signal line channel 30, the elastic member 400 can press the signal line through the curved notch 620, but not limited thereto.

In the above embodiments, the slot 35 is designed as a structure surrounded by the first wall surface 110 and at least a support portion 330. When the elastic member 400 is inserted into the slot 35, the first wall surface 110 abuts against one side of the elastic member 400 in the elastic extension direction D, and the at least a support portion 330 around the slot 35 limits or supports the elastic member 400 in the non-elastic extension direction. With such a configuration, at the side opposite to the first wall surface 110 may not be disposed with a wall surface, and by pressing the elastic member 400 directly or indirectly (through the pressing member 500), the position of the elastic member 400 can be readily adjusted, or the elastic member 400 can be removed from the slot 35. The slot 35 described above or shown in figures is merely illustrative. In another embodiment, the slot 35 can be defined by completely surrounding wall surfaces, such as four wall surfaces, but not limited thereto.

Referring to FIG. 7A and FIG. 7B, in this embodiment, in order to couple the components with each other, the components may have engaging structures corresponding to each other. For example, the first cover 310 can have two first pivot portions 350, and the second cover 320 can have two second pivot portions 360. The body 300 of the socket housing 100 have coupling portions 105 and 106, which correspond to the first pivot portions 350 of the first cover 310 and the second pivot portions 360 of the second cover 320, respectively. The first pivot portions 350 and the second pivot portions 360 can couple with the coupling portions 105 and 106, respectively, so that the first cover 310 and the second cover 320 can be rotatably connected to the body 300 as shown in FIG. 8 and FIG. 9. Moreover, the first cover 310 and the second cover 320 can have engaging members 710 and 720 (e.g., hole and hook) corresponding to each other. As shown in FIG. 8 and FIG. 9, when the first cover 310 and the second cover 320 are rotated close to each other, the first cover 310 and the second cover 320 can be positioned relative to each other by engaging the engaging member 710 with the engaging member 720. As such, the first cover 310 and the second cover 320 can be readily assembled to or detached from each other. When mounting the signal line managing member 200 and the signal line, the first cover 310 and the second cover 320 are firstly opened with respect to each other, and after the mounting of the signal line managing member 200 and the signal line, the first cover 310 and the second cover 320 are rotated to be engaged with each other. The engagement, connection, or assembly described above is merely illustrative, and not limited thereto.

In another embodiment, when the first cover 310 and the second cover 320 are fastened to each other, the signal line (e.g., the cable) or other components received therein can be pierced or pressed by the IDC to firmly build electrical connections or can be stably positioned, but not limited thereto.

In an embodiment, as shown in FIG. 7A and FIG. 7B, the pressing member 500 can have a limiting portion 501, and the elastic member 400 can have a hole 401. By inserting the limiting portion 501 into the hole 401, the pressing member 500 and the elastic member 400 can be assembled together, and the combination of the pressing member 500 and the elastic member 400 can be further disposed in the slot 35 of the socket housing 100, which has an integrally formed configuration or an assembled configuration. For example, as shown in FIG. 9, the combination of the pressing member 500 and the elastic member 400 can be disposed in the slot 35 of the socket housing 100 having the first cover 310 and the second cover 320, which are engaged with each other, but not limited thereto. The pressing member 500 and the elastic member 400 may have other suitable engaging structures to achieve the similar effect. In another embodiment, the elastic member 400 can be firstly inserted into the slot 35, and the pressing portion 500 is then mounted after the elastic member 400 inserted into the slot 35. That is, the components, assembly of components, and/or corresponding structures of the signal communication socket 16 are merely illustrative, which may be suitably modified according to practical applications.

Figure 10A:
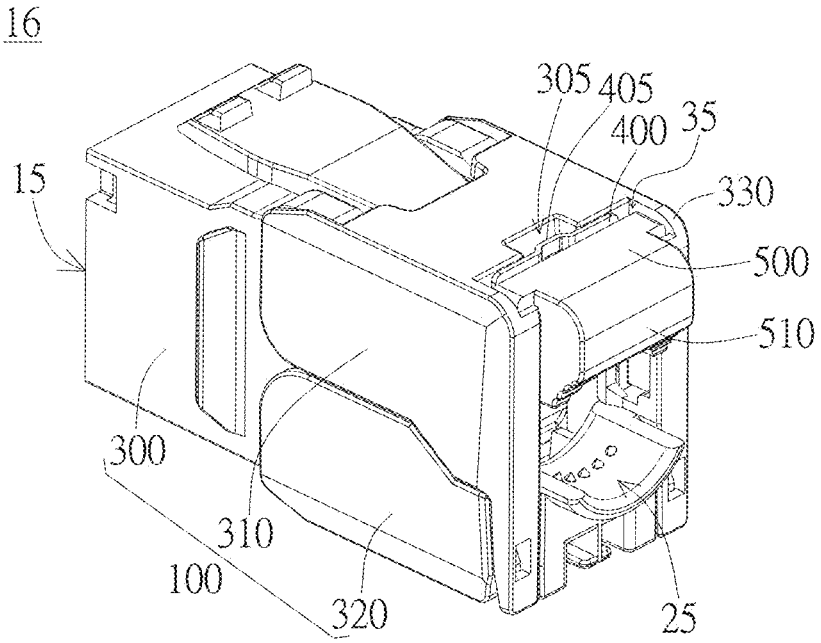
FIGS. 10A and 10B are schematic views of another embodiment of the signal communication socket having the elastic member and the pressing portion of the invention.
Figure 10B:
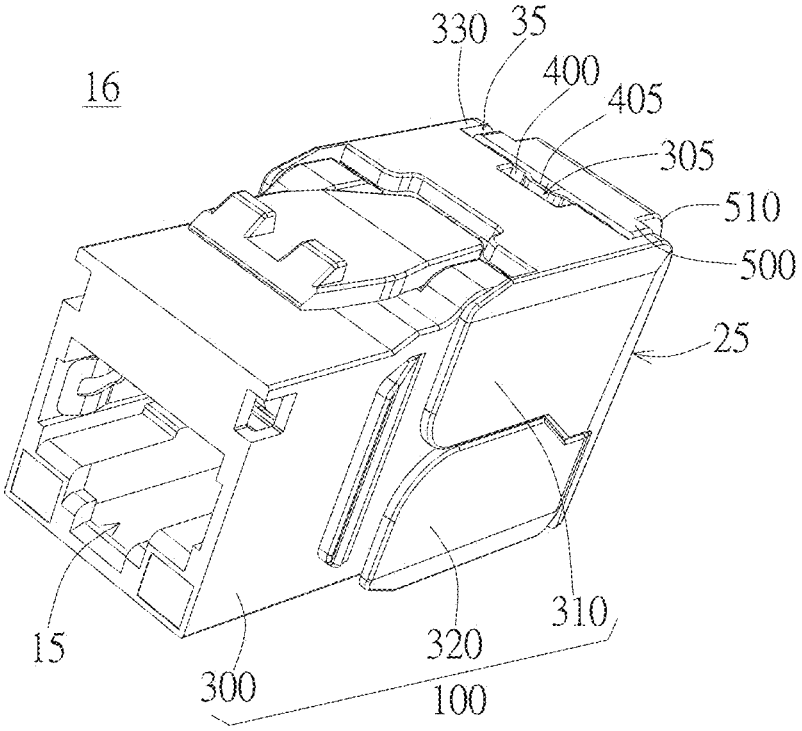

When the components shown in FIG. 7A and FIG. 7B are assembled with the elastic member 400 (or selectively with the pressing member 500) through FIG. 8 and FIG. 9, the signal communication socket 16 is formed, as shown in FIG. 10A and FIG. 10B. The signal line can be inserted into the signal communication socket 16 from the first inlet 25 and pressed by the elastic member 400 (or selectively by the pressing member 500), so that the connection stability of the signal line can be enhanced. For example, the signal line can be firstly inserted into the first inlet 25 after the assembly of FIG. 9 is completed, and the elastic member 400 (or selectively the pressing member 500) is inserted into the slot 35 to press or affix the signal line. When the signal line is to be removed, external force is applied to against the elastic force of the elastic member 400, so that the elastic member 400 can be loosened from the slot 35 and the pressing of the signal line is released.

Figure 11:
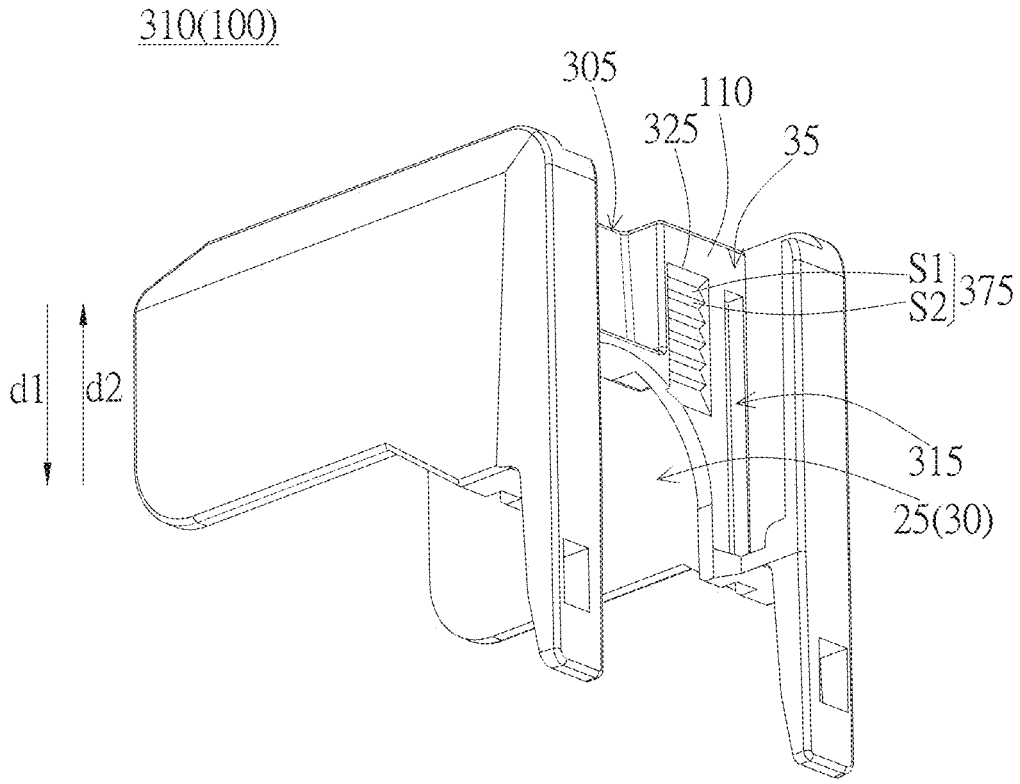
FIG. 11 is a schematic view of another embodiment of the signal communication socket of the invention showing the first wall surface formed with the stepped guiding structure.

In an embodiment, in order to firmly press or affix the signal lines of different sizes, the depth of the elastic member 400 inserted into the slot 35 toward the signal line channel 30 can be designed to be adjustable. For example, as shown in FIG. 11, the first wall surface 110 of the slot 35 formed at the first cover 310 of the socket housing 100 is enlargedly shown. In this embodiment, the first wall surface 110 can be formed with the interfering structure 325, which corresponds to the at least a protrusion of the elastic member 400, such as the abutting portion 425 shown in FIG. 6. The interfering structure 325 can be formed as a stepped guiding structure, which can consist of one or more tooth structures 375, and the tooth structures 375 have a plurality of first step surfaces S1 facing away from the signal line channel 30 and a plurality of second step surfaces S2 facing toward the signal line channel 30. The slope of the first step surfaces S1 can be smaller than that of the second step surfaces S2. With such a configuration, when assembling, the abutting portion 425 (shown in FIG. 6) of the elastic member 400 can easily slide along the step surfaces S1 step by step in the direction d1 toward the signal line channel 30. When the assembling is completed, i.e., the signal line is firmly pressed, the sliding of the abutting portion 425 of the elastic member 400 along the step surfaces S2 in the direction d2 away from the signal line channel 30 can be limited by the tooth structures 375. As such, the movement of the elastic member 400 toward the direction d2 can be restricted to firmly press the signal line, and the depth of the elastic member 400 can be modified according to the size (or diameter) of the signal line.

Figure 12A:
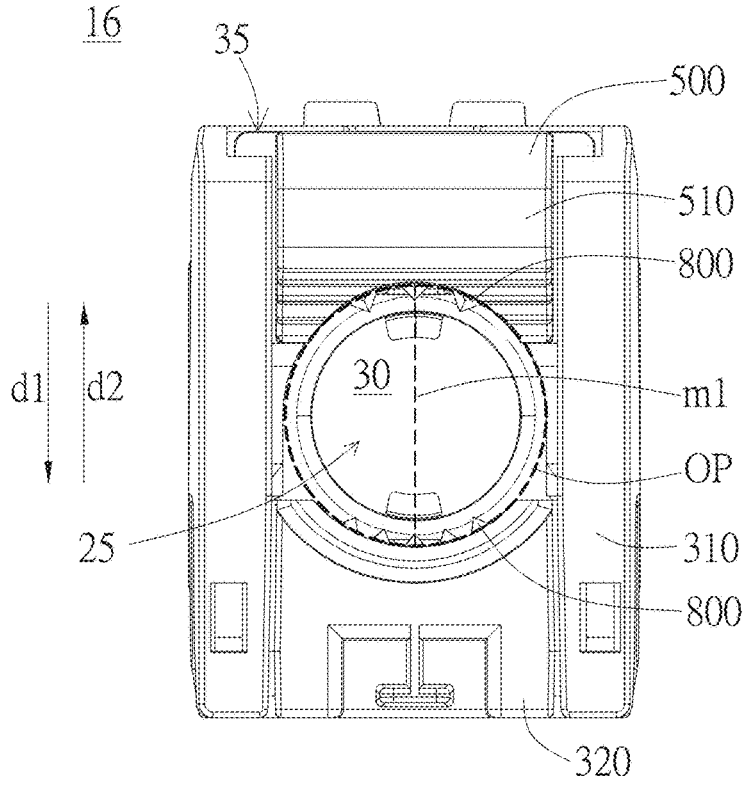
FIGS. 12A and 12B are schematic views of another embodiment of the signal communication socket of the invention showing the aperture adjustable by the elastic member and the pressing portion.
Figure 12B:
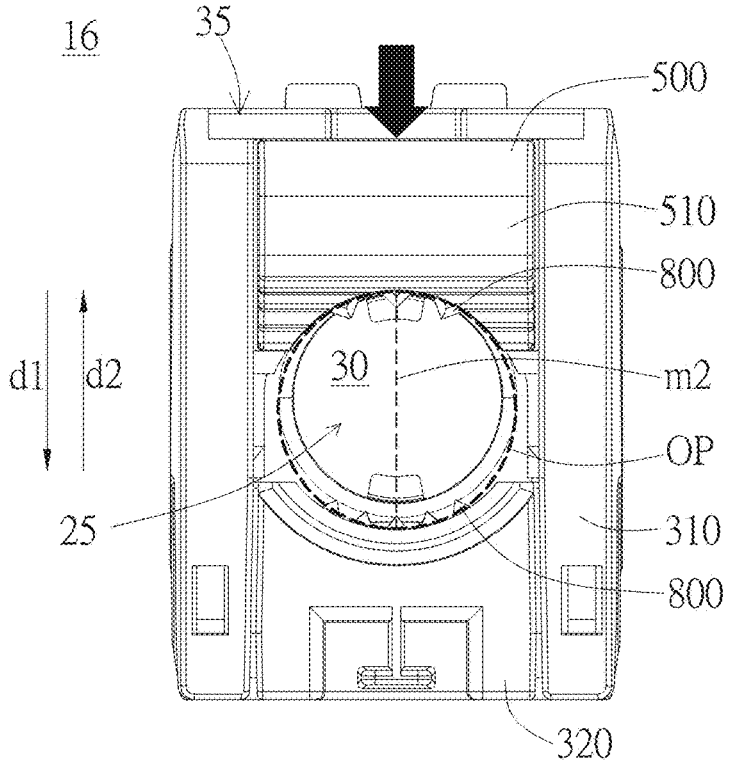

As shown in FIG. 11, FIG. 12A and FIG. 12B, the aperture m1 or m2 of the inlet OP of the signal line channel 30 can be adjusted by moving the elastic member 400, e.g., by pressing the pressing member 500, which is coupled with the elastic member 400. For example, the depth of the elastic member 400 inserted into the slot 35 can be adjusted by moving the elastic member 400 to enable the abutting portion 425 to abut against different tooth structures 375 of the interfering structure 325. For example, when inserting the signal line of larger size, the elastic member 400 can be moved along the first step surfaces S1 of the interfering structure 325 by a relatively shorter distance to the position shown in FIG. 12A. When inserting the signal line of smaller size, the elastic member 400 can be moved along the first step surfaces S1 of the interfering structure 325 by a relatively longer distance to the position shown in FIG. 12B.

When the signal line has a diameter corresponding to the aperture m1, which is larger than the aperture m2, by pressing the elastic member 400 (or the pressing member 500 coupled with the elastic member 400) along the direction d1, the signal line can be pressed in a state shown in FIG. 12A. When the signal line has a diameter corresponding to the aperture m2, which is smaller than the aperture m1, by further pressing the elastic member 400 (or the pressing member 500 coupled with the elastic member 400) along the direction d1, the signal line can be pressed in a state shown in FIG. 12B. As such, the position of the elastic member 400 (as well as the pressing member 500) can be adjusted according to the size of the signal line to enhance the connection and the stability of the signal lines of different sizes, and the signal communication socket 16 can be more feasibly applied to various signal lines. The depth of the elastic member 400 inserted into the slot 35 can be adjusted be different manners, not limited to the embodiments.

In another embodiment, as shown in FIG. 12A and FIG. 12B, the components that participate in defining the periphery of the signal line channel 30 such as the pressing member 500 and a part of the socket housing 100 (e.g., the second cover 320) can be disposed with a hindering structure 800. The fastening stability of the signal line (e.g., cable) can be further enhanced by the hindering structure 800 to prevent the signal line from loosening or swinging.

Figure 13:
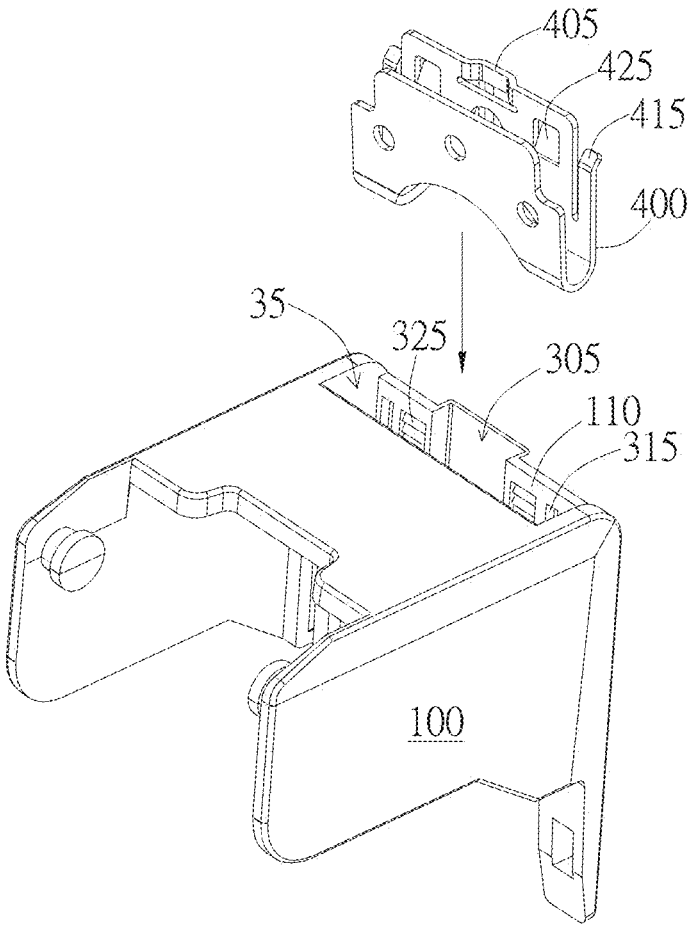
FIG. 13 is a schematic view of another embodiment of the signal communication socket of the invention showing the relative position of the first wall surface and the elastic member.

In an embodiment, the first wall surface 110 is a side wall surface of the slot 35 adjacent to the center of the socket housing 100, but not limited thereto. As shown in FIG. 13, in another embodiment, the first wall surface 110 can be a side wall surface of the slot 35 away from the center of the socket housing 100. As described above, the first wall surface can have various structures such as one or more of notch 305, positioning groove 315, interfering structure 325, and the elastic member 400 can have corresponding structures such as one or more of protrusion 405, positioning portion 415, abutting portion 425. When the elastic member 400 is inserted into the slot 35, the elastic member 400 abuts against the first wall surface 110 to be stably positioned in the slot 35.

Figure 14A:
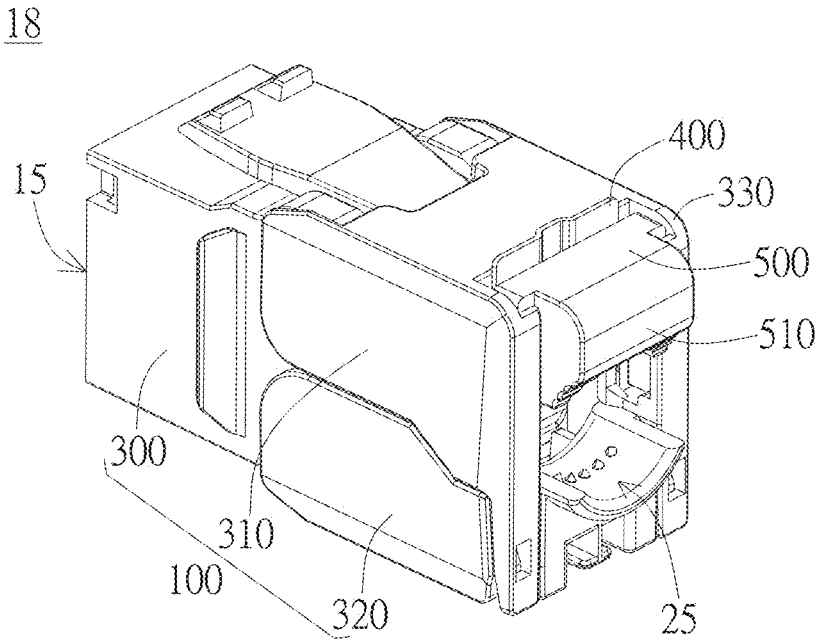
FIG. 14A and FIG. 14B are schematic views of the signal communication socket of the invention showing the elastic member in the slot.
Figure 14B:
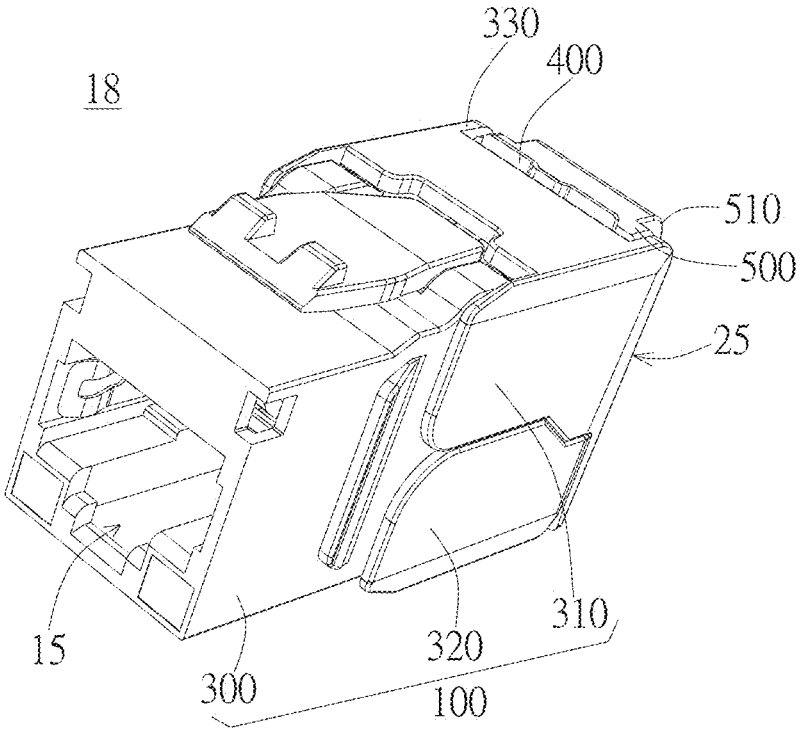

The corresponding structures of the elastic member 400 and the first wall surface 110 are merely illustrative, and one or more structures can be selectively disposed according to practical applications. For example, in another embodiment, for the signal communication socket 18 shown in FIG. 14A and FIG. 14B, the first wall surface 110 may be dispensed with the notch 305, and the signal communication socket 18 is configured to allow the elastic member 400 to be inserted into the slot 35 and to at least partially protrude outside the socket housing 100 from the slot 35. As such, by applying external force to the portion of the elastic member 400 outside the socket housing 100, the elastic member 400 can be loosened and removed.

The signal communication socket of the invention can realize the firmly positioning of the signal line and improve the convenience of assembly or disassembly. Therefore, the application and reliability of the signal communication socket can be promoted to reduce the complexity or difficulty of assembling or disassembling the signal communication socket and to avoid the defects caused by using additional restriction members such as the cable tie.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A signal communication socket for connecting a signal line, comprising:

a socket housing defining a signal line channel therein and a slot thereon to communicate with the signal line channel, the signal line channel extending along a first direction, the slot extending along a second direction, the second direction crossing the first direction, the slot having at least a first wall surface; and an elastic member detachably inserted into the slot, the elastic member abutting against the first wall surface through elastic extension in the first direction when no external force is applied, thereby being positioned at the socket housing, wherein one side of the elastic member toward the signal line channel defines a part of a periphery of the signal line channel.

2. The signal communication socket of claim 1, further comprising a signal line managing member disposed in the signal line channel.

3. The signal communication socket of claim 1, wherein the socket housing comprises a body and a first cover detachably or rotatably connected to the body; the slot is formed at the first cover; when the first cover is assembled with the body, the slot communicates with the signal line channel.

4. The signal communication socket of claim 1, wherein the elastic member has a pressing portion protruding from the elastic member opposite to the first wall surface.

5. The signal communication socket of claim 1, further comprising a pressing member, wherein the pressing member couples with the elastic member at a side opposite to the first wall surface and protrudes away from the elastic member.

6. The signal communication socket of claim 1, wherein the elastic member has at least a protrusion toward the first wall surface.

7. The signal communication socket of claim 6, wherein the at least a protrusion comprises an abutting portion, and the first wall surface is formed with an interfering structure; when the elastic member is inserted into the slot, the abutting portion interferes with the interfering structure.

8. The signal communication socket of claim 7, wherein the interfering structure is a stepped guiding structure having a plurality of first step surfaces facing away from the signal line channel and a plurality of second step surfaces facing toward the signal line channel; a slope of the first step surfaces is smaller than that of the second step surfaces.

9. The signal communication socket of claim 6, wherein the at least a protrusion comprises a positioning portion; the first wall surface is formed with a positioning groove; when the elastic member is inserted into the slot, the positioning portion is inserted into the positioning groove.

10. The signal communication socket of claim 6, wherein the first wall surface is formed with at least a notch; when the elastic member is inserted into the slot, at least a portion of the elastic member is exposed outside the socket housing from the at least a notch.

11. The signal communication socket of claim 1, wherein when the elastic member is inserted into the slot, the elastic member partially protrudes beyond the slot to be exposed outside the socket housing.

12. The signal communication socket of claim 1, wherein a depth of the elastic member inserted into the slot is adjustable, and an aperture of an inlet of the signal line channel is adjusted by moving the elastic member.

13. The signal communication socket of claim 1, wherein the elastic member is a U-shaped elastic member.

14. The signal communication socket of claim 13, wherein a U-shaped opening of the U-shaped elastic member faces away from the signal line channel.

15. The signal communication socket of claim 1, wherein a side of the elastic member corresponding to the signal line channel has a curved notch.

16. The signal communication socket of claim 1, wherein the socket housing has at least a support portion around the slot; when the elastic member is inserted into the slot, the support portion supports the elastic member.

17. The signal communication socket of claim 1, wherein the signal line channel has a first inlet communicating externally; the elastic member is disposed corresponding to an edge of the first inlet.

* * * * *